US006758225B2

(12) United States Patent
Thompson et al.

(10) Patent No.: US 6,758,225 B2
(45) Date of Patent: Jul. 6, 2004

(54) REFUSE BIN CLEANING APPARATUS AND METHODS OF USING SAME

(75) Inventors: Gary Michael Thompson, 22A Laneside Close, Chapel-en-le-Firth, High Peak, Derbyshire SK23 OTS (GB); Andrew Quigley, Matlock (GB)

(73) Assignee: Gary Michael Thompson, High Peak (GB)

( * ) Notice: Subject to any disclaimer, the term of this patent is extended or adjusted under 35 U.S.C. 154(b) by 15 days.

(21) Appl. No.: 10/168,154

(22) PCT Filed: Dec. 14, 2000

(86) PCT No.: PCT/GB00/04774

§ 371 (c)(1),
(2), (4) Date: Jun. 14, 2002

(87) PCT Pub. No.: WO01/44081

PCT Pub. Date: Jun. 21, 2001

(65) Prior Publication Data

US 2002/0189650 A1 Dec. 19, 2002

(30) Foreign Application Priority Data

Dec. 15, 1999 (GB) ..... 9929578

(51) Int. Cl.[7] ..... B08B 9/20

(52) U.S. Cl. ..... 134/22.18; 134/24; 134/167 R; 134/148; 134/152

(58) Field of Search ..... 134/22.1, 22.18, 134/24, 167 R, 168 R, 148, 152

(56) References Cited

U.S. PATENT DOCUMENTS

| | | | | |
|---|---|---|---|---|
| 4,694,846 A | * | 9/1987 | Bouchard | 134/78 |
| 5,560,781 A | * | 10/1996 | Banks et al. | 134/1 |
| 5,964,229 A | * | 10/1999 | Brendel | 134/52 |
| 6,554,008 B2 | * | 4/2003 | Dewey et al. | 134/22.18 |

FOREIGN PATENT DOCUMENTS

| | | |
|---|---|---|
| AU | 36823/97 | 12/1998 |
| DE | 1924562 | 11/1970 |
| DE | 2901599 | 7/1980 |
| EP | 0137416 | 4/1985 |
| EP | 0559541 | 9/1993 |
| EP | 0628500 | 12/1994 |
| FR | 2645775 | 10/1990 |
| GB | 2321843 | 8/1998 |

* cited by examiner

*Primary Examiner*—Frankie L. Stinson
*Assistant Examiner*—Saeed T Chaudhry
(74) *Attorney, Agent, or Firm*—Bracewell & Patterson, LLP

(57) ABSTRACT

Provided is an apparatus and methods for cleaning bins including a lance provided with a nozzle assembly for discharging cleaning fluid (and optionally drying air) towards the inner wall surfaces of a bin. The lance can be advanced into and retracted from the bin while undergoing lateral displacement to maintain the nozzle assembly in close proximity with the inner wall surfaces during cleaning (and optionally drying). The lance can have a rastering mode of operation which is used when the forward end of the lance is adjacent the base of the bin.

32 Claims, 5 Drawing Sheets

REFUSE BIN CLEANING APPARATUS AND METHODS OF USING SAME

The present invention concerns an automated cleaning device for cleaning domestic and/or industrial refuse bins.

Current bin cleaning devices are typically manually operated, and may comprise brushes, sprays or high pressure jets. These devices will be inserted into the container being cleaned, and the operator will manually control the washing process until he deems that the inner walls of the container are clean. The bins may then be left to dry, inverted or otherwise, or may be dried manually by an operator.

While the prior art methods for cleaning bins are advantageous in being adaptable for varying sizes of bins, these methods are very labour intensive, often utilize large volumes of cleaning fluid, and may not be efficient at removing residual matter on the inner walls of the bin.

Whilst some efforts have been made to provide easy and effective automation of refuse container washing, the results tend to be wasteful in terms of cleaning fluid, and are less amenable to adaptation for differently sized containers.

The present invention addresses the problems encountered in prior art devices, and provides an economical, size-adaptable, efficient and automated apparatus and method for cleaning refuse bins or other containers.

According to one aspect of the present invention there is provided apparatus for cleaning bins comprising a support for locating a bin in a tilted orientation so that liquid can drain from the bin through its top opening, a cleaning lance mounted in cantilever fashion on the base for longitudinal movement into and out of a bin located on the support, the lance being provided at or adjacent its free end with fluid discharge means for discharge of cleaning fluid and being mounted on the base in such a way that the fluid discharge means is movable in planes substantially orthogonal to the direction of longitudinal movement of the lance, and control means operable to effect such movements of the lance.

The lance may be telescopic in order to effect said longitudinal movement into and out of the bin. Preferably however such longitudinal movement of the lance is effected by mounting the lance on a carriage which, in turn, is mounted on the base.

According to a second aspect of the present invention there is provided apparatus for cleaning bins comprising a support for locating a bin in a tilted orientation so that liquid can drain from the bin through its top opening, a base mounting a carriage for movement towards and away from the support, a cleaning lance mounted in cantilever fashion on the carriage so as to move into and out of a bin located on the support as the carriage is moved towards and away from the support, the lance being provided at or adjacent its free end with fluid discharge means for discharge of cleaning fluid and being mounted on the carriage in such a way that the fluid discharge means is movable in planes substantially orthogonal to the direction of movement of the carriage, and control means operable to effect such movements of the carriage and the fluid discharge means.

In use, the control means may be operated so that the fluid discharge means is moved towards and away from the base of the bin when the latter is supported on the support and also in said substantially orthogonal planes whereby the fluid discharge means follows a path in close proximity to internal side wall surfaces of the bin while discharging cleaning fluid at such surfaces.

The lance may be mounted for angular oscillation to afford the fluid discharge means at least one degree of freedom in said substantially orthogonal planes.

The lance may be mounted for translational movement to afford the fluid discharge means at least one degree of freedom in said substantially orthogonal planes.

In a presently preferred embodiment, the lance is mounted for angular oscillation about two substantially mutually orthogonal axes in order to afford the fluid discharge means two degrees of freedom in said substantially orthogonal planes.

The control means is conveniently adjustable to allow the extent of movement of the fluid discharge means in said substantially orthogonal planes to be varied in dependence on the cross-sectional dimensions of the bins to be cleaned.

The control means is preferably operable to move the fluid discharge means in said substantially orthogonal planes simultaneously with movement of the carriage in at least one direction relative to the support.

The support may be arranged to accommodate more than one bin at a time, in which case the apparatus is conveniently provided with more than one lance for use in the cleaning of respective bins, each lance being provided with respective fluid discharge means.

Where more than one lance is provided, preferably the apparatus comprises a single carriage for mounting the lances. However, the possibility provided separate carriages each mounting a respective lance is not excluded.

Preferably the support comprises a bin-tilting frame and a bin-lifting sub-frame.

The tilting frame may be angularly movable relative to the base about an axis generally perpendicular to the direction of movement of the carriage.

The bin-lifting sub-frame may be slidable relative to the bin-tilting frame in a direction generally perpendicular to the axis about which the tilting frame is angularly movable.

The fluid discharge means may be operable to discharge both cleaning fluid and drying fluid towards the internal surfaces of the bin in use, the arrangement conveniently being such that cleaning fluid is discharged during advance of the fluid discharge means towards the base of the bin and drying fluid is discharged during retraction of the fluid discharge means from the bin.

According to a further aspect of the present invention there is provided apparatus for cleaning bins comprising a support for locating a bin in a tilted orientation so that liquid can drain from the bin through its top opening, a cleaning lance mounted in cantilever fashion on the base for longitudinal movement into and out of a bin located on the support, the lance being provided at or adjacent its free end with fluid discharge means for discharge of cleaning fluid and drying fluid whereby following cleaning of the interior of the bin, drying of the bin can be effected using drying fluid.

The invention will now be described by way of example only with reference to the accompanying drawings in which.

Figure 1:
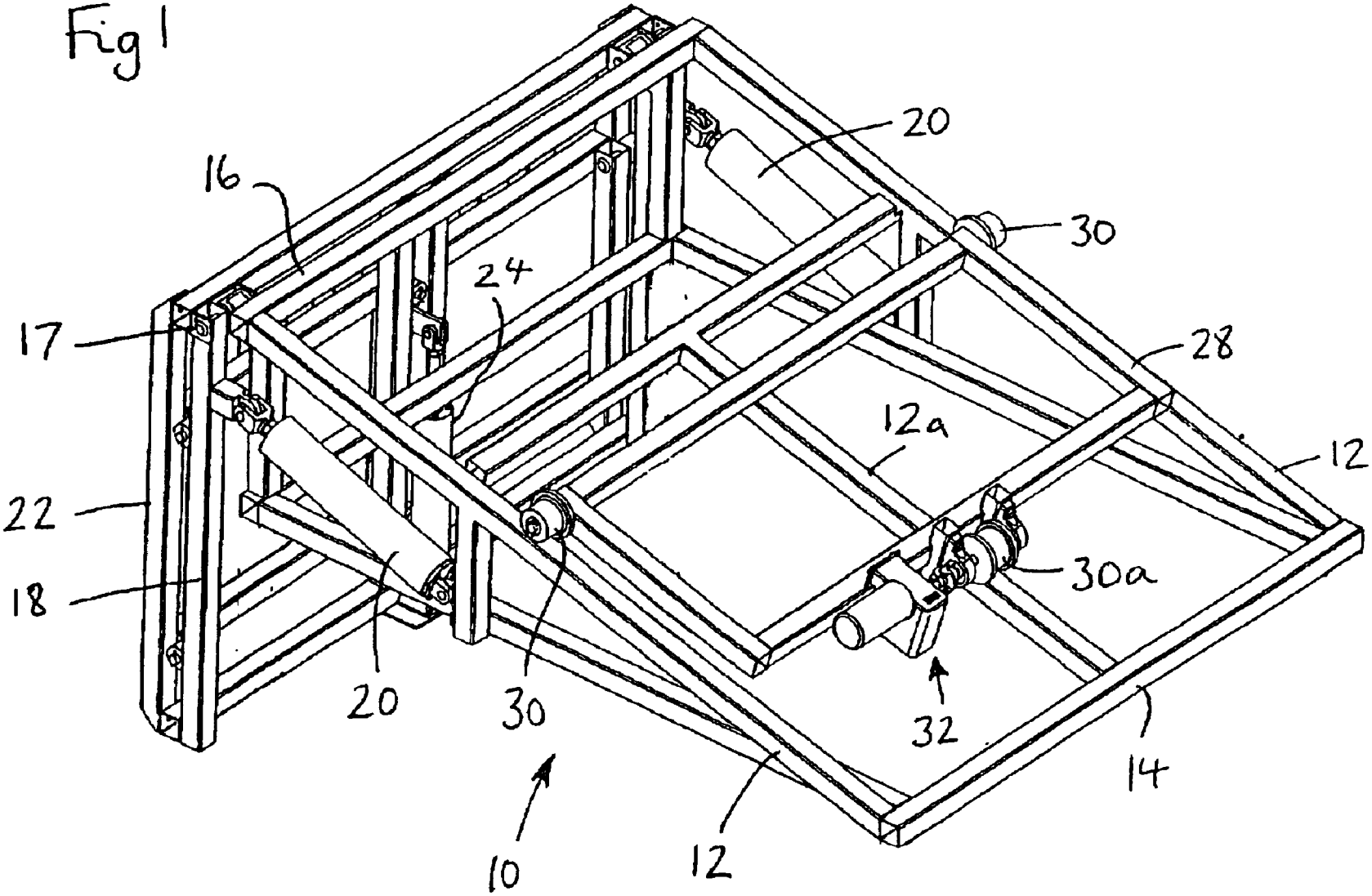
FIG. 1 is a perspective view of the base, support and lifting frames of one embodiment of apparatus in accordance with the invention, viewed from the rear.

Referring now to the drawings, whilst not intended for use with any particular type of bin design, the bin cleaning apparatus is particularly useful for cleaning the interior of so-called "wheelie bins" and is designed to clean bins of various capacities, either two at a time in the case of smaller capacity bins or one at a time in the case of large capacity bins. Bins in domestic and commercial use typically have capacities of 120, 240 liters and 360 liters in the case of domestic bins and up to 1100 liters in the case of commercial bins.

The bins typically comprise a floor standing base with upstanding side walls terminating at a top opening through which refuse is inserted into the bin. In cross-section, the bin is usually of square or rectangular configuration. Adjacent its top end, the bin may be provided with a lid hinged at one side (the back wall) and a handle usually in the form of a bar extending horizontally across one side of the bin and located adjacent or coincident with the hinge axis in the case where the bin is hinged. The lower end of the bin is provided with wheels. Commercial-type bins usually have four wheels, one at each corner. In the case of domestic bins, wheels are usually provided on one side and are so located that when tilted the base of the bin is moved clear of the ground and the load is supported via the wheels thus allowing the bin to be moved around relatively easily when fully loaded. The bins are usually produced with a external lip L (see FIG. 5) around the top opening which may be used as a purchase point for hooking the bin at its front wall lip on to a bin inverting device as used on refuse collection vehicles for emptying the contents of the bin.

Figure 2:
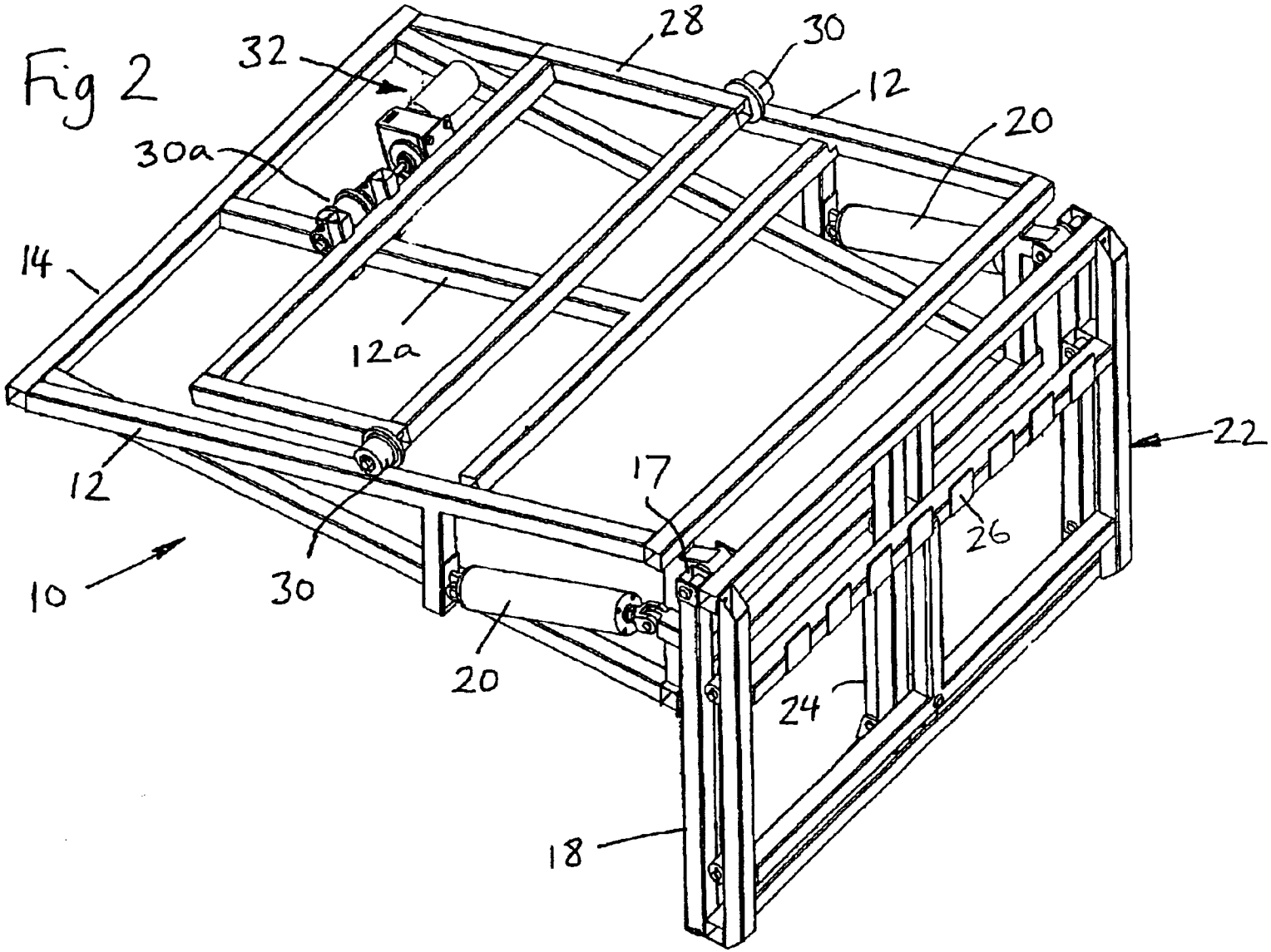
FIG. 2 is a perspective view of the base, support and lifting frames, viewed from the front.

The apparatus comprises a base frame 10 which is intended to be mounted on a vehicle or a wheeled trailer to allow transport to sites where bin cleaning is to be carried out. The base frame 10 has inclined parallel guide side rails 12 and central rail 12*a* which slope upwardly from lower bar 14 at the rear end of the base frame to upper bar 16 at its forward end. A bin tilting frame 18 is pivotally connected via pivots 17 to the base frame 10 at its forward end 16 for movement between a generally vertical loading position as shown in FIGS. 1 and 2 and a raised support position (see FIG. 5) in which the tilting frame 18 is tilted at substantially the same angle as the guide rails 12, such tilting movement being effected by means of fluid-powered piston and cylinder assemblies 20 acting between the base frame 10 and the tilting frame 18.

The tilting frame 18 slidably mounts a bin-lifting frame 22 for movement towards and away from the upper bar 16 under the control of fluid-powered piston and cylinder assembly 24. The lifting frame 22 is provided with a number of bin attachment projections 26 which form a "comb" and are intended to engage the lip at the front of a bin and thereby attach a floor-standing bin to the lifting frame 22 and hence the tilting frame 18. The lifting frame 22 is movable from a lower position in which the hook projections are generally located below the level of the front wall lip when the bin is floor standing to a raised position in which it engages the lip and then raises the bin away from the floor to a level at which the top opening in the bin B is at substantially the same level as the upper bar 16. Where the bin is of the lidded variety, the lid will initially be opened before operating the tilting frame to move the bin to the tilted position.

The lifting frame 22 is used to raise the bin in this manner when the tilting frame is in its bin-loading position so that when the bin has been lifted fully out of contact with the ground, it may then be tilted by raising the tilting frame into its support position. In this orientation, the bin opening 23 is presented towards the rear end of the base frame and the main axis of the bin is substantially parallel with the guide rails 12, 12*a* (as shown diagrammatically in FIG. 5). When the bin is in its tilted position, its main axis will therefore slope downwardly so as to allow cleaning fluid to drain away under gravity. A collection vessel (not shown) will be located at a suitable position to collect the used cleaning fluid for filtration and recycle. If desired, the tilting angle of the bin may be more pronounced than illustrated in FIG. 5 in order to secure more effective draining of the bin.

Where smaller capacity bins are to be cleaned, two may be located side-by-side for pick up by the lifting frame 22 and tilting by the tilting frame 18. In the case of large capacity bins, the bins are handled one at a time.

A carriage 28 is mounted by means of guide rails 12, 12*a*, the carriage having wheels 30 which seat on guide rails 12 and a drive wheel 30*a* which engages the central guide rail 12*a*, the latter wheel being coupled to a drive motor/gear box unit 32 which is mounted on the carriage 28. The motor is reversible so that the carriage can be driven forwardly towards the upper bar 16 or rearwardly towards lower bar 14 (see arrows X in FIG. 5).

Figure 4:
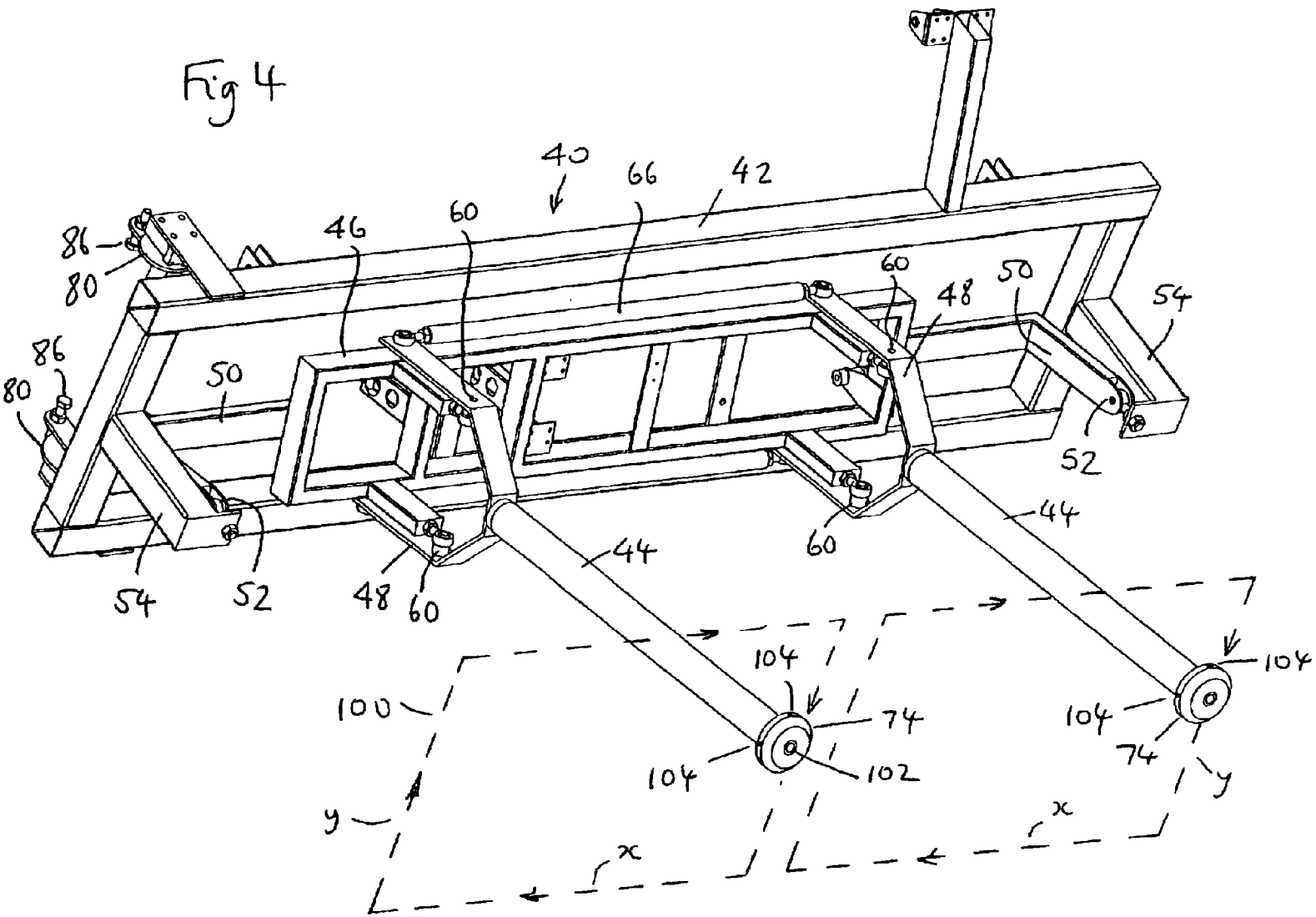
FIG. 4 is a perspective view of the cleaning unit of the apparatus, viewed from the front.
Figure 5:
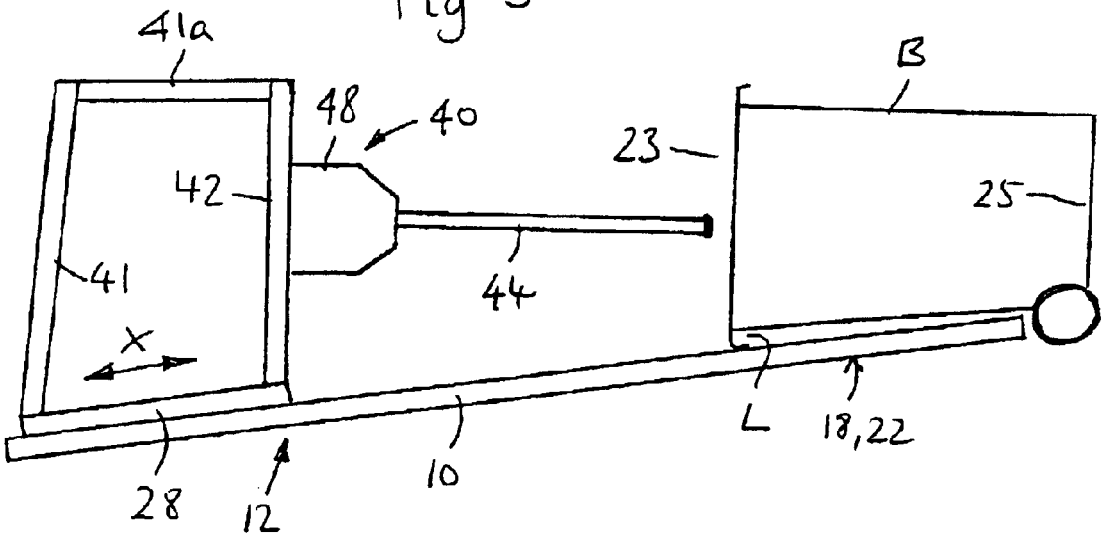
FIG. 5 is a diagrammatic view showing the cleaning unit mounted on the base frame via a carriage.

A cleaning unit 40 (see FIGS. 3 to 5) is mounted on the carriage 28 via posts 41 and forwardly extending arms 41*a* (see FIG. 5). The cleaning unit comprises a reactangular main frame 42 mounting a pair of lances 44 through a gimbals-type arrangement comprising rectangular sub-frame 46 and generally U-shaped structures 48 each carrying a lance 44. The sub-frame 46 includes a pair of L-shaped arms 50 at each side thereof, the forwardly projecting ends of which are pivotally connected at 52 to arms 54 extending forwardly from the main frame 42 so that the sub-frame 46 can be oscillated angularly about a generally horizontal axis defined by pivots 52. Such angular oscillation is effected by means of a fluid-powered piston and cylinder assembly (not shown) acting between a pivot point afforded by bracket 56 on the main frame 42 and a pivot 58 located at the rear of the sub-frame 46.

The U-shaped structures 48 are each pivotally connected at 60 to forwardly projecting arms 62 on the sub-frame 46 for angular oscillation about respective axes defined by the pivots 60, which axes are substantially perpendicular to the horizontal axis defined by pivots 52. Angular oscillation of the U-shaped structures 48 and the lances 44 is co-ordinated by links 66 which couple the U-shaped structures 48 and is effected by a fluid-powered piston and cylinder assembly (not shown) acting between the suitable points on the sub-frame 46 (see attachment point 68) and one of the U-shaped structures. Damping cylinders (not shown) may also provided in conjunction with the piston and cylinder assemblies for effecting angular oscillation of the lances to smooth the oscillatory movement.

The cleaning unit 40 is mounted on the carriage 28 so that the lances 44 project in the forward direction towards the tilting frame 18 for entry into the bin or bins B supported on the raised tilting frame 18 in use. As the carriage 28 is advanced along the guide rails 12, 12*a* by operation of the motor/gear box unit 32, the lances pass through the "top" opening 23 of the tilted bins and move towards the bases 25 thereof. Each lance 44 is provided with a nozzle assembly 74 at its forward end for discharging cleaning liquid and drying air, the liquid and air supplies to the lance and nozzle assemblies 74 being provided for example via flexible supply lines (not shown). While not illustrated, the lance may comprise a steel tube along which the cleaning fluid is supplied and the air supply may be located externally of the tube, the central tube and the air supply lines being enclosed in a heavy duty plastics tube.

By appropriate operation of the piston and cylinder assemblies which effect angular oscillation of the sub-frame 46 and the U-shaped structures 48, each lance is movable in two mutually orthogonal degrees of freedom relative to the carriage 28 allowing control in such a way that the nozzle assemblies 74 execute a well-defined trajectory corresponding to the internal cross-section of the bins to be cleaned, e.g. as illustrated the path of travel 100 of each nozzle assembly 74 may be generally rectangular. By appropriate control of the extent of angular oscillation, the trajectory of nozzle travel may be contoured to the bin interior so that the nozzles travel in close proximity around the interior of the bins. It will be understood that such angular oscillation of the lances will take place during advance and retraction of the carriage 28 so that the nozzle assemblies 74 may pass over, in close proximity to, substantially the entire inner surface of the bins.

The extent of angular oscillation is adjustable to cater for bins of different capacities and hence allow close proximity tracking of the inner bin wall surfaces by the nozzle assemblies 74. The oscillation of sub-frame 46 about the horizontal axis may be limited by upper and lower limit switches (not shown) operated by upper and lower discs 80 provided on spindle 82 which is mounted on the main frame 42 for vertical movement. The spindle 82 is provided with lateral projections 84 carrying adjustable bolts 86 which co-operate with a jockey wheel 88 mounted on one of the side arms 50.

Figure 3:
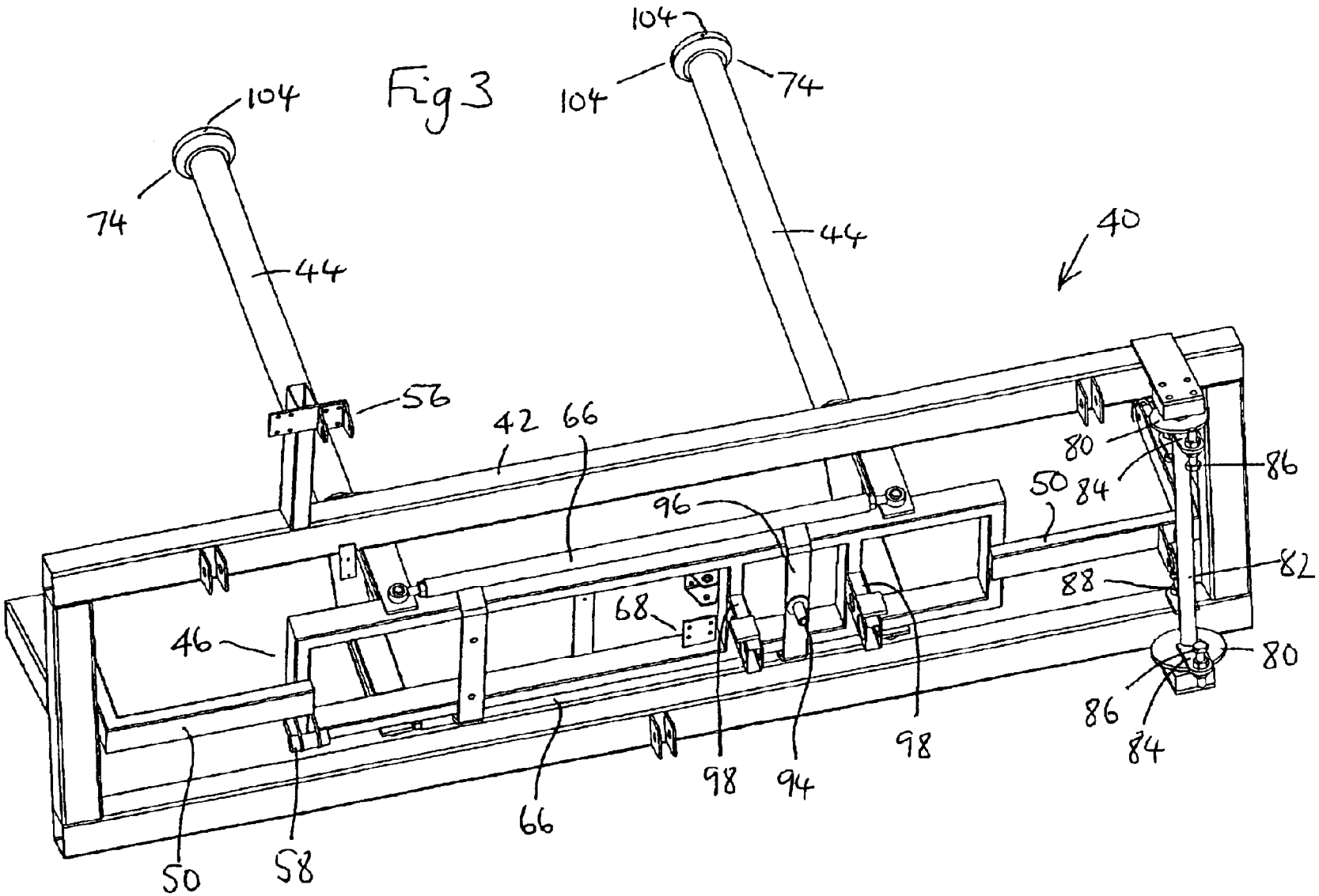
FIG. 3 is a perspective view of the cleaning unit of the apparatus, viewed from the rear.

The spindle 82 is shown in FIGS. 3 and 4 in an inoperative position in which adjustment of the bolts is possible to allow the limits of oscillation to be varied; in use, the bolts 86 are positioned diametrically opposite to the location seen in FIGS. 3 and 4 so as to co-operate with the jockey wheel 88. As the sub-frame 46 rises and falls, the jockey wheel 88 moves into abutment with the upper and lower bolts 86 thereby displacing the assembly of disc/spindle assembly up or down and operating the associated limit switch which, in turn, causes the piston and cylinder assembly associated with sub-frame 46 to be in readiness for movement of the sub-frame in the reverse direction at the appropriate time.

Oscillation of the U-shaped structures 48 is controlled by a recessed cylinder 90 (see FIG. 7) mounted between rearwardly projecting arms 98 of the sub-frame 66. The recess 92 in the cylinder receives a pin 94 carried by strap 96 secured to and extending between the links 66. The cylinder 90 is mounted for limited axial sliding movement between arms 98, the main axis 99 of the cylinder being substantially horizontal and the cylinder being angularly adjustable about that axis. The recess 92 progressively widens in the circumferential direction so that the degree of lost motion M between the pin 94 and the cylinder 90 is determined by the width of the groove 92 at the point of reception of the pin 94.

Figure 7:
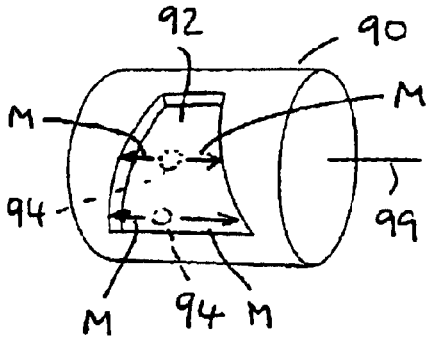
FIG. 7 is a perspective view of a control cylinder for adjusting the extent of angular oscillation of the lances in one plane orthogonal to the axes of the lances.

As the lances oscillate about the axes defined by pivots 60, the pin 94 travels to and fro from one side of the the recess 92 to the other and, on engaging each side, and shifts the cylinder in the direction of its axis to operate limit switches located adjacent each end of the cylinder 90 in readiness, at the appropriate time, for reverse operation of the piston and cylinder assembly which produces oscillation about the pivots 60. By adjusting the cylinder 90 about its axis, it will be seen that the pin 94 registers with the recess 92 at different width locations thereby increasing or reducing the degree of lost motion between the pin and cylinder and hence the varying the extent of movement that can occur before reversal of the associated piston and cylinder assembly takes place. In FIG. 7, two positions of pin 94 are illustrated In the lower position, there is greater lost motion resulting in a large amplitude of angular oscillation.

From the above, it will be appreciated that the effect of adjusting the bolts 86 and the cylinder 90 is to vary the length of travel of the nozzle assemblies in the directions x and y in FIG. 4.

The nozzle assemblies 74 are illustrated diagrammatically in the drawings and may take various forms consistent with discharging cleaning fluid and drying air at the internal wall surfaces of the bins. The nozzle assemblies are supplied with suitable cleaning fluid (e.g. water containing additives such as detergent and/or biocide) and drying fluid (e.g. compressed air). The fluid supplies are pressurised to afford enhanced cleaning/drying.

Figure 6:
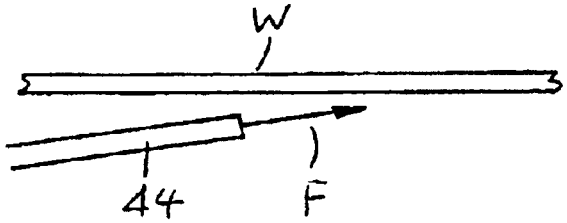
FIG. 6 is a diagrammatic view showing the orientation of the cleaning lances relative to the bin side walls during use.

In one embodiment, each nozzle assembly is arranged to discharge the cleaning fluid substantially forwardly from an outlet 102 at the end of the respective lance and, in this case, the attitude of the lances as they move along the interior of the bins towards the base of the bin is controlled in such a way that the lance points towards the side walls W so that cleaning fluid F impinges on the side wall surface at a glancing angle (see FIG. 6) to enhance the cleaning effect.

The drying air may also be discharged at the side walls of the bins in the same manner, e.g. from an outlet at the end of the lance. The drying air may be discharged forwardly of the lance and/or laterally of the lance. For instance, the nozzle assemblies may include laterally discharging outlets for the cleaning fluid and/or the drying air and in the case of the drying air the laterally directed nozzles may be arranged to discharge at an angle towards the bin walls in the rearward direction so as to "drive" the used cleaning fluid towards the bin opening . For instance, there may be four such lateral outlets 104 arranged equidistantly from each other around the axis of the lance (see FIG. 4) and the arrangement may be such that the discharge of fluid (cleaning fluid and/or drying air) is co-ordinated with the position of the nozzle assembly so that the fluid is only discharged from only those lateral outlets that are directed towards the side wall surface undergoing cleaning and/or drying at any particular time during the cycle of operation. Thus, for example, the lateral discharge outlets may be valve controlled, with the valves being opened only when the outlet is in close proximity and confronting relation with a respective side wall.

A preferred feature of the invention resides in using the nozzle assemblies for effecting drying of the bin interiors in addition to cleaning. Thus, bin cleaning may be carried out during advance of the lances towards the base of the bins while bin drying is carried out during withdrawal. In both instances, the nozzle assemblies are caused to track the inner wall surfaces of the bins in the manner described above. The drying air may be supplied in such a way that the pressurized air is effective to drive the residual liquid in the bin towards its open end as the lance moves in the direction of withdrawal from the bin. This may be achieved for example by appropriate orientation of the laterally discharging outlets. Although it is preferred to effect bin cleaning during the advance stroke of the lance and bin drying on the retraction stroke, it will be appreciated that other possibilities exist. For instance, the lances may undergo two cycles of advance and retraction, bin cleaning being carried out during the first cycle and bin drying being carried during the second cycle.

Another preferred feature of the invention is the use of a "rastering" type mode of operation of the lance adjacent the bottom of the bin so as to produce effective cleaning of the bin bottom. This is achieved by appropriate programming of the circuitry controlling of the lance oscillatory movements. Thus, starting from for example the lower right hand corner of the bin bottom, the forward end of the lance may be caused to sweep to and fro between the extremities of its oscillation in one direction (e.g. side-to-side) and gradually incremented stepwise upwardly until the forward end of the lance reaches the uppermost edge of the bin bottom. During such rastering motion, the cleaning fluid will be discharged at the bin base. On completion of this phase of the rastering operation, it may be reversed to move the foward end of the lance back to the bottom edge of the bin base while discharging drying air at the bin base. At each step, the lance may be oscillated back and forth for one or more traverses depending on the intensity of cleaning desired. The lance may then be withdrawn from the bin in the manner described previously. It will be appreciated that, instead of rastering the lance from side-to-side and incrementing it stepwise up or down, the rastering may be in the up-down direction and the stepwise incrementing may be side-to-side.

Bin cleaning using apparatus as described above gives potential substantial savings in water usage and chemicals used for cleaning. Typically a two-lance cleaner will employ a collective cleaning fluid flow rate of the order of 35 liters/minute (i.e. 17.5 liters per lance) and a discharge pressure of the order of 2000 psi. The apparatus may be made filly automatic so that the only action required on the part of the operator is to locate the bin or bins in position, fold back the bin lids, adjust controls (e.g. cylinder 90 and bolts 86) according to the capacities and cross-sectional dimensions of the bins to be cleaned and then operate a pushbutton or the like for initiating the cleaning and drying cycle. The cleaning and drying cycle then progresses automatically step by step culminating in withdrawal of the lances and return of the bins to their floor standing orientation by reverse operation of the tilting frame 18 and the lifting frame 22.

What is claimed is:

1. Apparatus for cleaning bins comprising a support for locating a bin in a tilted orientation so that liquid can drain from the bin through its top opening, a cleaning lance mounted in cantilever fashion on a base for longitudinal movement into and out of a bin located on the support, the lance being provided at or adjacent its free end with fluid discharge means for discharge of cleaning fluid and being mounted on the base in such a way that the fluid discharge means is movable in planes substantially orthogonal to the direction of longitudinal movement of the lance, and control means operable to effect such movements of the lance, said apparatus further including means for effecting a rastering-type motion of the lance.

2. Apparatus as claimed in claim 1 in which the lance is telescopic in order to effect said longitudinal movement into and out of the bin.

3. Apparatus as claimed in claim 1 in which the support is arranged to locate a bin in a tilted orientation so that liquid can drain from the bin through its top opening, the base mounts a carriage for movement towards and away from the support, the cleaning lance being mounted in cantilever fashion on the carriage so as to move into and out of a bin located on the support as the carriage is moved towards and away from the support.

4. Apparatus as claimed in claim 1 in which the control means is operable to move the fluid discharge means towards and away from the base of the bin when the latter is supported on the support and also in said substantially orthogonal planes whereby the fluid discharge means follows a path in close proximity to internal side wall surfaces of the bin while discharging cleaning fluid at such surfaces.

5. Apparatus as claimed in claim 1 in which the lance is mounted for angular oscillation to afford the fluid discharge means at least one degree of freedom in said substantially orthogonal planes.

6. Apparatus as claimed in claim 1 in which the lance is mounted for translational movement to afford the fluid discharge means at least one degree of freedom in said substantially orthogonal planes.

7. Apparatus as claimed in claim 1 in which the lance is mounted for angular oscillation about two substantially mutually orthogonal axes in order to afford the fluid discharge means two degrees of freedom in said substantially orthogonal planes.

8. Apparatus as claimed in claim 1 in which the control means is adjustable to allow the extent of movement of the fluid discharge means in said substantially orthogonal planes to be varied in dependence on the cross-sectional dimensions of the bins to be cleaned.

9. Apparatus as claimed in claim 1 in which the control means is operable to move the fluid discharge means in said substantially orthogonal planes simultaneously with movement of the carriage in at least one direction relative to the support.

10. Apparatus as claimed in claim 1 in which the support is arranged to accommodate more than one bin at a time.

11. Apparatus as claimed in claim 10 in which more than one lance is provided for use in the cleaning of respective bins, each lance being provided with respective fluid discharge means.

12. Apparatus as claimed in claim 11 having a single carriage for mounting the lances.

13. Apparatus as claimed in claim 1 in which the support comprise a bin-tilting frame and a bin-lifting sub-frame.

14. Apparatus as claimed in claim 13 in which the tilting frame is angularly movable relative to the base about an axis generally perpendicular to the direction of movement of the carriage.

15. Apparatus as claimed in claim 13 in which the bin-lifting frame is slidable relative to the bin-tilting frame in a direction generally perpendicular to the axis about which the tilting frame is angularly movable.

16. A method of cleaning a bin comprising:

a) tilting the bin into an attitude such that liquid will drain from the bin under gravity;

b) advancing a cleaning lance through the bin opening towards the base of the bin, the lance being provided with fluid discharge means at or adjacent its forward end;

c) as the forward end of the lance advances toward the base of the bin, discharging cleaning fluid through the fluid discharge means; and d) retracting the lance from the bin and as the forward end of the lance is retracted from the bin, discharging drying fluid from the fluid discharge means.

17. A method as claimed in claim 16 in which the lance is telescopic and is moved longitudinal by extension and retraction of its telescoping parts.

18. A method of cleaning a bin comprising:

a) tilting the bin into an attitude such that liquid will drain from the bin under gravity;

b) advancing a cleaning lance through the bin opening towards the base of the bin, the lance being provided with fluid discharge means at or adjacent its forward end;

c) supplying cleaning fluid to the lance during such advance;

d) moving the lance laterally of said direction of advance so that the fluid discharge means follows a path of movement corresponding to the internal cross-section of the bin during advance towards said base; and e) subjecting the lance to a rastering-type motion when the forward end of the lance is adjacent the base of the bin.

19. A method as claimed in claim 18 in which the lance is telescopic and is moved into and out of the bin by extension and retraction of its telescoping parts.

20. A method as claimed in claim 18 in which the cleaning fluid is discharged at a glancing angle towards the bin side walls during advance of the lance.

21. A method as claimed in claim 18 in which compressed air is supplied to the lance for discharge during withdrawal of the lance from the bin.

22. A method as claimed in claim 18 further comprising moving the lance laterally of said direction of advance so that the fluid discharge means follows a path of movement corresponding to the internal cross-section of the bin during withdrawal of the lance away from said bin base.

23. A method as claimed in claim 18 in which steps (a) to (e) are effected automatically.

24. A method as claimed in claim 18 further comprising adjusting the extent of lateral movement of the lance in dependence on the cross-sectional area of the bin to be cleaned.

25. A method as claimed in claim 18 in which more than one bin is cleaned at a time, each bin being cleaned using a respective lance.

26. A method as claimed in claim 18 in which the rastering mode of operation is effected when the forward end of the lance is adjacent the base of the bin.

27. A method as claimed in claim 26 in which the rastering motion comprises traverse in one direction transverse to the lance axis and a stepwise movement in a direction orthogonal to the lance axis and said one direction.

28. A method of cleaning a bin comprising:

a) tilting the bin into an attitude such that liquid will drain from the bin under gravity;

b) advancing a cleaning lance through the bin opening towards the base of the bin, the lance being provided with fluid discharge means at or adjacent its forward end;

c) supplying cleaning fluid to the lance during such advance;

d) effecting withdrawal of the lance from the bin;

e) supplying drying fluid to the lance during withdrawal; and f) moving the lance laterally of said direction of advance and withdrawal so that the fluid discharge means follows a path of movement corresponding to the internal cross-section of the bin during advance towards said bin base and during withdrawal from the bin.

29. Apparatus for cleaning bins comprising a support for locating a bin in a tilted orientation so that liquid can drain from the bin through its top opening, a cleaning lance mounted in cantilever fashion on a base for longitudinal movement into and out of a bin located on the support, the lance being provided at or adjacent its free end with fluid discharge means for discharge of cleaning fluid and being mounted on the base in such a way that the fluid discharge means is movable in planes substantially orthogonal to the direction of longitudinal movement of the lance, and control means operable to effect such movements of the lance, the lance being mounted for translational movement to afford the fluid discharge means at least one degree of freedom in said substantially orthogonal planes.

30. A method for cleaning bins comprising:

a) locating a bin support in a tilted orientation so that liquid can drain from the bin through its top opening;

b) advancing a cleaning lance longitudinally into the bin located on the support, the cleaning lance mounted in cantilever fashion on a base and provided with fluid discharge means at or adjacent its forward end, the fluid discharge means movable in planes substantially orthogonal to a direction of longitudinal of the lance; and c) subjecting the lance to a rastering-type motion when the forward end of the lance is adjacent the base of the bin, supplying cleaning fluid to the lance and discharging the cleaning fluid through said fluid discharge means.

31. A method as claimed in claim 30 in which the fluid discharge means is operable to discharge both cleaning fluid and drying fluid towards the internal surfaces of the bin.

32. A method as claimed in claim 31, the arrangement being such that cleaning fluid is discharged during advance of the fluid discharge means towards the base of the bin and drying fluid is discharged during retraction of the fluid discharge means from the bin.

* * * * *